US009656770B2

(12) United States Patent
Ikegami et al.

(10) Patent No.: US 9,656,770 B2
(45) Date of Patent: May 23, 2017

(54) METHOD OF FILLING A CONTAINER WITH ANIMAL LITTER

(71) Applicant: UNICHARM CORPORATION, Ehime (JP)

(72) Inventors: Takeshi Ikegami, Kagawa (JP); Kenji Hiroshima, Kagawa (JP)

(73) Assignee: Unicharm Corporation, Ehime (JP)

( * ) Notice: Subject to any disclaimer, the term of this patent is extended or adjusted under 35 U.S.C. 154(b) by 382 days.

(21) Appl. No.: 14/265,814

(22) Filed: Apr. 30, 2014

(65) Prior Publication Data

US 2015/0314895 A1 Nov. 5, 2015

(51) Int. Cl.

| | |
|---|---|
| ***B65B 1/06*** | (2006.01) |
| ***B65B 1/36*** | (2006.01) |
| ***B65B 29/00*** | (2006.01) |
| ***B65B 43/56*** | (2006.01) |
| ***B65B 1/32*** | (2006.01) |
| *B65B 39/00* | (2006.01) |

(52) U.S. Cl.

CPC ..... *B65B 1/06* (2013.01); *B65B 1/32* (2013.01); *B65B 1/36* (2013.01); *B65B 29/00* (2013.01); *B65B 43/56* (2013.01); *B65B 2039/009* (2013.01)

(58) Field of Classification Search

CPC . B65B 1/06; B65B 1/32; B01F 15/026; B01F 5/241

USPC ..... 141/83, 103–106

See application file for complete search history.

(56) References Cited

U.S. PATENT DOCUMENTS 3,239,198 A * 3/1966 Albright ..... B01F 5/241 366/134

3,802,582 A * 4/1974 Brock ..... B65G 69/10 222/462

FOREIGN PATENT DOCUMENTS

JP 2004-195336 A 7/2004

* cited by examiner

*Primary Examiner* — Timothy L Maust
*Assistant Examiner* — Timothy P Kelly
(74) *Attorney, Agent, or Firm* — Brinks Gilson & Lione

(57) ABSTRACT

A filling method for filling a container with animal litter, whereby large-sized granules and small-sized granules can be easily filled into containers in a predetermined blending ratio, and essentially the same blending ratio can be maintained for different containers. In a supply step in which the animal litter is supplied to a hopper, the animal litter is allowed to freely drop from above the storage space of the hopper, and in the storage space there are formed a first region in which the blending ratio of the small-sized granules with respect to the large-sized granules in a unit mass of the animal litter is equal to or less than the predetermined blending ratio and a second region in which the ratio is greater than the predetermined blending ratio, in an arrangement along the lengthwise direction of the storage space. Also, in a filling step in which the animal litter is filled into containers, delivery holes capable of delivering the animal litter of the first region and delivery holes capable of delivering the animal litter of the second region are selected, and the animal litter is delivered in the predetermined amount at least once each from each of the selected delivery holes, filling the containers so that the large-sized granules and small-sized granules in the unit amount are in the predetermined target blending ratio.

20 Claims, 6 Drawing Sheets

METHOD OF FILLING A CONTAINER WITH ANIMAL LITTER

TECHNICAL FIELD

The present invention relates to a filling method for filling a container, such as a bag with animal litter that is to be spread in an animal toilet for dogs or cats that are kept as indoor pets.

BACKGROUND ART

As animal litter for use in animal toilets for cats and the like that are raised indoors, there are widely known types that employ as the major starting material, for example, bentonite that swells and exhibits cohesive force upon absorption of urine and fluids in excreta, or that comprise various kinds of materials, such as paper molded into pellets (pellet types).

Such animal litter is subjected to treatment, such as heating after being molded into pellets, and then filled and wrapped in prescribed amounts in containers, such as bags for shipment as a product, and shipped. When such animal litter is filled into a container, the animal litter is first stored in a storage hopper and then passed through multiple delivery holes provided in the hopper, whereby the animal litter in the hopper is filled in prescribed amounts into multiple containers.

The animal litter is sometimes formed with different particle diameters during molding, or commonly portions may be removed and broken up during transport after molding, creating animal litter with smaller particle diameters than the designed particle diameters. Consequently, the animal litter includes large-sized granules having the predesigned particle diameters, and small-sized granules having particle diameters that are smaller than the large-sized granules.

On the other hand, when only large-sized granules are filled into a container during filling of the animal litter into a container, relatively large spaces form between the adjacent large-sized granules. When this occurs, the amount that can be filled into the container is reduced and it may not be possible to ensure the prescribed absorbing power for animal excreta to be exhibited by the full amount of animal litter filled into a single container.

In recent years, therefore, filling has been carried out while combining the large-sized granules and small-sized granules in a single container, so that the small-sized granules become disposed in the spaces formed by the multiple large-sized granules, thereby increasing the overall surface area of the animal litter filled in the single container and ensuring the prescribed absorbing power for animal excreta.

As mentioned above, when the large-sized granules and small-sized granules are combined and filled into a single container, it is necessary to fill the large-sized granules and small-sized granules into the container in the prescribed blending ratio. Also, when animal litter is filled into a container, and the blending ratio of the large-sized granules and small-sized granules is significantly different from that in other containers, this may result in differences in absorbing power of the entire animal litter filled into each of the containers, and for this reason it is necessary to consistently combine the animal litter in a fixed blending ratio.

Consequently, as described in PTL 1 for example, the large-sized granules and small-sized granules are stored in separate hoppers while a prescribed amount of the small-sized granules delivered from the small-sized granule hopper are combined with the large-sized granules delivered from the large-sized granule hopper, and they are then filled into the containers.

With the type described in PTL 1 it is necessary to store the large-sized granules and small-sized granules in separate hoppers, and therefore a large space is required. Also, since it is necessary to provide separate apparatuses for combination of the small prescribed amounts of small-sized granules with the large-sized granules, this has led to the problem of increased size and complexity of the equipment used to fill the animal litter into containers.

CITATION LIST

Patent Literature

[PTL 1] Japanese Unexamined Patent Publication No. 2004-195336

SUMMARY OF THE INVENTION

Technical Problem

The technical problem of the invention is to provide a filling method of filling a container with animal litter, whereby large-sized granules and small-sized granules can be easily filled into a container in a prescribed blending ratio, and essentially the same blending ratio can be maintained for different containers.

Solution to Problem

In order to solve this problem, the method of filling a container with animal litter according to the invention is as follows.

(1) Method of filling a container with animal litter, wherein animal litter including large-sized granules having predetermined particle diameters and small-sized granules having particle diameters smaller than the large-sized granules is supplied to a storage hopper having a storage space extending in one horizontal direction, and the animal litter stored in the storage space is delivered from a plurality of delivery holes provided along the lengthwise direction of the storage space on the bottom edge side of the hopper, and filled into the containers that are to be filled, the method comprising a supply step in which the animal litter is supplied into the storage space of the hopper, a measuring step in which the animal litter in the storage space is delivered from each of the delivery holes and the blending ratio of the large-sized granules and small-sized granules in the predetermined unit amount delivered from each of the delivery holes is measured, and a filling step in which the animal litter is filled into the containers through delivery holes selected based on the measurement results obtained in the measuring step, wherein in the supply step, the animal litter is freely dropped from above the storage space of the hopper, so that there are formed in the storage space a first region in which the blending ratio of the small-sized granules with respect to the large-sized granules in the predetermined unit amount for the animal litter is equal to or less than the predetermined blending ratio and a second region in which the blending ratio of the small-sized granules with respect to the large-sized granules in the predetermined unit amount for the animal litter is greater than the predetermined blending ratio, aligned in the lengthwise direction of the storage space, and in the filling step, delivery holes that can deliver animal litter in the first region and delivery holes that can deliver animal litter in the second region are selected based on the measurement results from the measuring step, the animal litter being delivered in exactly the predetermined amount from each of the selected delivery holes at least once each and filled into the containers, so that the large-sized granules and small-sized granules are in the predetermined target blending ratio in the unit amount.

(2) The method of filling a container with animal litter according to (1) above, wherein in the supply step, the free dropping of the animal litter from above the storage space of the hopper is carried out at the center location in the lengthwise direction of the storage space.

(3) The method of filling a container with animal litter according to (1) or (2) above, wherein the hopper is provided with a plurality of delivery holes at sections located in the first region and the plurality of delivery holes at sections located in the second region of the animal litter in the storage space, and in the filling step, the animal litter is delivered through the delivery holes from the first region and the second region into multiple containers, simultaneously and in equal amounts, simultaneously filling the animal litter into the containers.

(4) The method of filling a container with animal litter according to any one of (1) to (3), wherein the hopper has a first delivery hole group comprising a plurality of delivery holes disposed close to one end in the lengthwise direction of the storage space and a second delivery hole group comprising a plurality of delivery holes disposed close to the other end, with the dropping target location in the storage space of the animal litter during the supply step as the reference point, the first delivery hole group and second delivery hole group each having n number of delivery holes, wherein in the filling step, the animal litter is delivered from each of the injection holes of the first delivery hole group, and filled into containers disposed for each delivery hole, and then animal litter is delivered and filled from each injection hole located at the nth to 1st position from the reference point side of the second delivery hole group, into each container that has been filled with animal litter from each injection hole located at the 1st to nth position from the reference point side of the first delivery hole group.

(5) The method of filling a container with animal litter according to any one of (1) to (4), wherein the hopper is provided with delivery holes aligned at equal spacing and in a straight line along the lengthwise direction of the storage space.

(6) The method of filling a container with animal litter according to any one of (1) to (5), wherein the filling step fills the container with the animal litter by simultaneously delivering animal litter from two or more different delivery holes into each container.

(7) The method of filling a container with animal litter according to any one of (1) to (6), wherein the measuring step measures the blending ratio of the large-sized granules and the small-sized granules in the unit amount by using a sieve to sift predetermined amounts of animal litter delivered from the delivery holes that are to be measured, into the large-sized granules and the small-sized granules.

Advantageous Effects of Invention

According to the invention, animal litter is freely dropped from above the storage space of the hopper during the supply step in which animal litter is supplied to the storage space of the hopper, thereby forming in the storage space a first region and a second region with mutually differing blending ratios of the large-sized granules and small-sized granules in the unit amount. Also, in the filling step in which animal litter is filled into the container, delivery holes capable of delivering the animal litter of the first region and of the second region are selected, and animal litter is delivered in the predetermined amount at least once each for each of the selected delivery holes, filling the containers so that the large-sized granules and small-sized granules in the unit amount are in the predetermined target blending ratio.

This allows animal litter in the first region and animal litter in the second region to be blended and easily filled into the containers in the predetermined blending ratio, while adjusting the blending ratio of the large-sized granules and small-sized granules in the unit amount, and allows any container to be stably filled with an approximately consistent blending ratio for the container.

DESCRIPTION OF EMBODIMENTS

Figure 1:
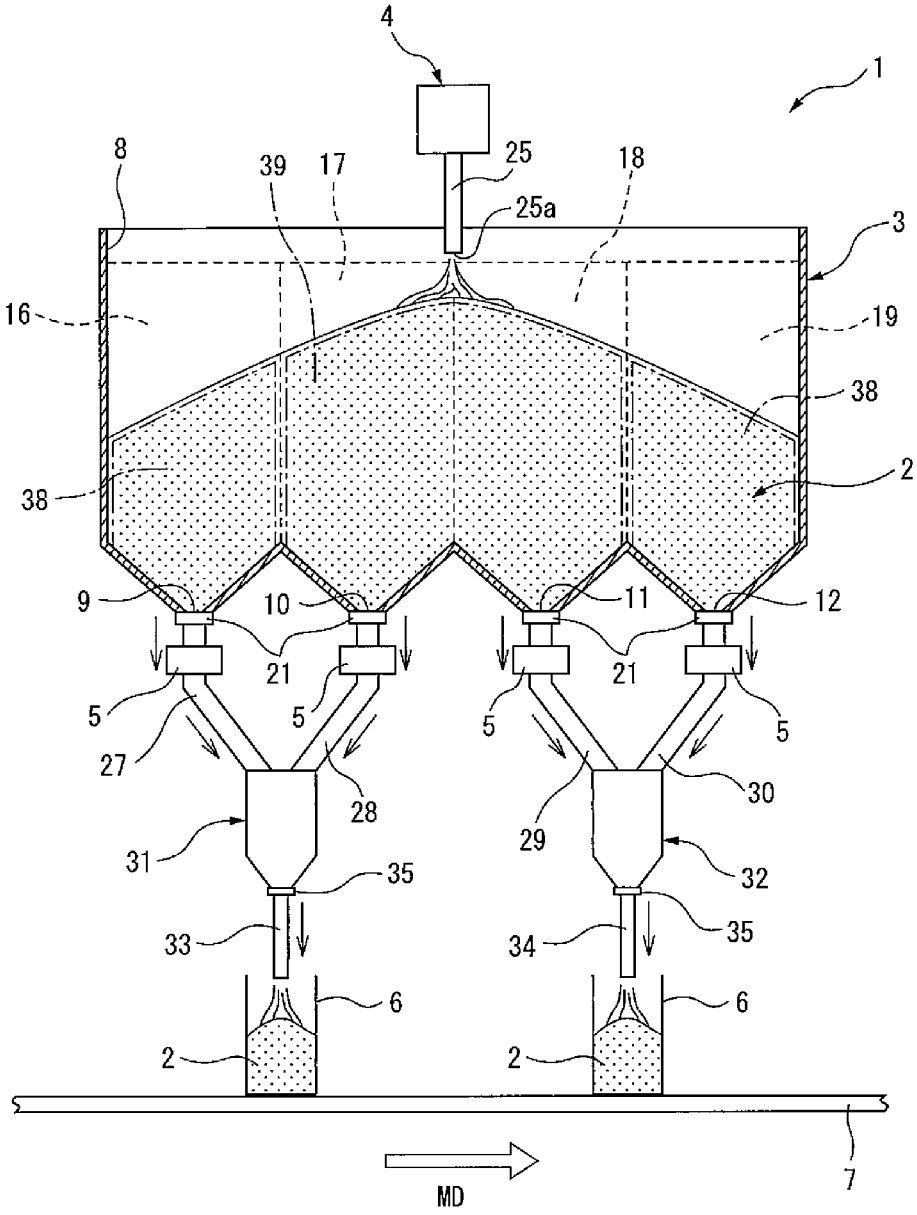
FIG. 1 is a partial cut-away front view schematically showing an example of an apparatus for carrying out a first embodiment of the method of filling animal litter into containers according to the invention.
Figure 2:
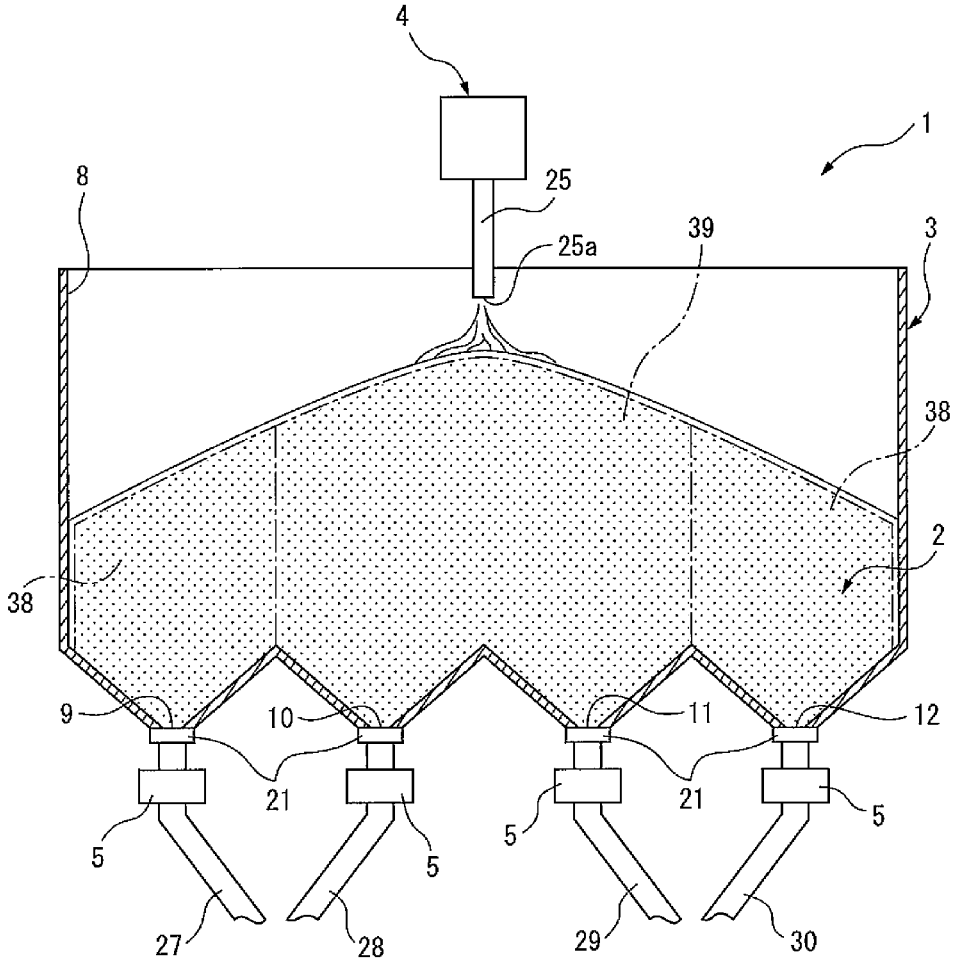
FIG. 2 is an essential magnified cross-sectional view schematically showing the storage hopper of the apparatus of FIG. 1.
Figure 3:
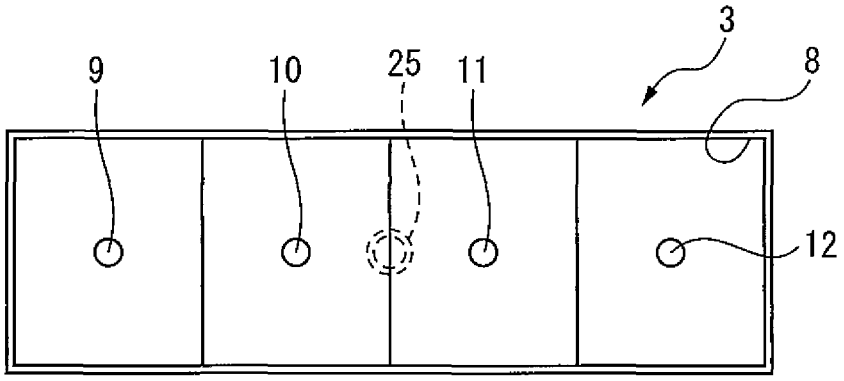
FIG. 3 is a plan view schematically showing the storage hopper of the apparatus of FIG. 1.

For more detailed illustration of the method of filling a container with animal litter according to the invention, FIG. 1 to FIG. 3 show an example of an apparatus for carrying out a first embodiment of a method of producing animal litter for the invention.

Specifically, as shown in FIG. 1, the apparatus 1 is provided with a storage hopper 3 that stores animal litter 2, a feeder 4 that supplies animal litter 2 to the hopper 3, measuring devices 5 that measure amounts of animal litter 2 delivered from the hopper 3, and a conveying apparatus 7 that conveys containers 6 filled with animal litter that has been delivered from the hopper 3.

The hopper 3 extends in one horizontal direction, and in the hopper 3 there is formed a hollow storage space 8 extending in the one horizontal direction, that houses and stores animal litter 2 supplied from the feeder. Also, on the bottom edge side of the hopper 3 there are provided a plurality of delivery holes 9-12 that deliver animal litter 2 housed in the storage space 8 to the exterior.

As shown in FIG. 3, the plurality of delivery holes 9-12 are formed on the bottom edge side of the hopper 3 along the lengthwise direction of the storage space 8, arranged at equal spacings and in a straight line, while each of the delivery holes 9-12 is disposed at a location corresponding to the center in the widthwise direction of the storage space 8.

The hopper 3 has a structure in which the bottom edge side is formed into a roughly square pyramidal funnel shape that gradually narrows toward the delivery holes 9-12 in the direction of the lower end. Thus, the animal litter 2 stored in the storage space 8 gradually collects toward the nearest delivery holes 9-12 as it moves downward in the storage space 8.

For this embodiment, the hopper 3 has four delivery holes, i.e. first to fourth delivery holes 9-12, the first to fourth delivery holes 9-12 being provided equally and at the same mutual spacing along the full length in the lengthwise direction of the storage space 8 of the hopper 3.

Thus, as shown in FIG. 1, where the storage space 8 of the hopper 3 is divided into essentially 4 equal parts in the lengthwise direction of the storage space 8, the animal litter 2 present in each of the four spaces in the storage space 8, i.e. the first to fourth spaces 16-19, can be delivered from the first to fourth delivery holes 9-12, respectively, that are located nearest each of the spaces 16-19.

The hole diameters of the first to fourth delivery holes 9-12 will depend on the particle diameters of the animal litter 2. However, for example, when the particle diameter of the animal litter 2 is about 2 mm in the production step, they are preferably about 50 to 300 mm.

In the apparatuses shown FIG. 1 to FIG. 3, the first and fourth delivery holes 9, 12 among the first to fourth delivery holes 9-12 are disposed at locations near both sides in the lengthwise direction of the storage space 8 of the hopper 3, the second delivery hole 10 being disposed at a location near the first delivery hole 9 at the center side in the lengthwise direction of the storage space 8, and the third delivery hole 11 being disposed at a location near the fourth delivery hole 12 at the center side in the lengthwise direction of the storage space 8.

The design is also such that, of the entire storage space 8, the animal litter 2 located in the first space 16 can be delivered from the first delivery hole 9, the animal litter 2 located in the second space 17 can be delivered from the second delivery hole 10, the animal litter 2 located in the third space 18 can be delivered from the third delivery hole 11 and the animal litter 2 located in the fourth space 19 can be delivered from the fourth delivery hole 12.

Also, in the first to fourth delivery holes 9-12 there are mounted opening and closing valves 21 that execute delivery and cutoff of the animal litter 2 from the first to fourth delivery holes 9-12. Thus, for the first to fourth delivery holes 9-12, delivery and cutoff of the animal litter 2 is controlled by opening and closing of the first to fourth delivery holes 9-12 by the respective opening and closing valves 21.

Opening and closing of the opening and closing valves 21 is controlled by a controller (not shown).

The feeder 4 supplies animal litter 2, that has been produced in the production step and conveyed, into the storage space 8 of the hopper 3, and it is provided with a supply pipe 25 having its bottom edge side introduced into the hopper 3, and optional conveying means (not shown), such as a belt conveyor, that feeds animal litter 2 that has been produced in the production step into the supply pipe 25.

The supply pipe 25 has its supply port 25*a* formed at the bottom end facing into the storage space 8, and it is able to supply animal litter 2 through the supply port 25*a* of the supply pipe 25, into the storage space 8 of the hopper 3.

Also, the feeder 4 has a construction such that the animal litter 2 passes through the supply port 25*a* of the supply pipe 25 and drops freely from above into the storage space 8 of the hopper 3, thereby supplying the animal litter 2 into the storage space 8.

Furthermore, the feeder 4 has the supply port 25*a* of the supply pipe 25 disposed at the center location in the lengthwise direction of the storage space 8, at the center in the widthwise direction of the storage space 8. This allows the feeder 4 to accomplish free dropping of the animal litter 2 from above the storage space 8 of the hopper 3, at the center location in the lengthwise direction of the storage space 8.

The feeder 4 may continuously supply the animal litter 2 into the storage space 8 of the hopper 3, or it may supply fresh animal litter 2 when the animal litter 2 has reached a certain amount in the storage space 8 of the hopper 3.

The conveying apparatus 7 is able to convey the container 6, disposed below the hopper 3, in the direction along the lengthwise direction of the storage space 8, with the top of the container 6 in an open state (the machine direction MD in FIG. 1). Also, when the animal litter 2 is to be filled into the container 6, the container 6 is moved to a location for filling of the animal litter 2, and after filling of the animal litter 2 is complete, the container 6 that has been completely filled with the animal litter 2 is conveyed to the next step (for example, a step of closing the container opening).

The conveying apparatus 7 used may be a belt conveyor comprising an endless belt, or a roller conveyor comprising a roller. In order to maintain the container 6 in an open posture at the top during this time, the conveying apparatus 7 is preferably provided with a rail to prevent it from overturning, or an arm that holds the container to prevent it from overturning.

Also, the container 6 conveyed by the conveying apparatus 7 may be a known type of container that has an opening at the top and whose opening can be closed after filling of the animal litter, and for example, a synthetic resin or paper bag or box may be used.

Incidentally, for this embodiment there are provided guide pipes 27-30 at each of the first to fourth delivery holes 9-12, that guide the animal litter 2 delivered from each of the delivery holes 9-12 and distribute the animal litter 2 downward. The guide pipes 27-30 are each constructed so that their upstream end (top edge side) is connected to the corresponding delivery hole 9-12, while their downstream end extends downward allowing animal litter to flow into the pipe.

Specifically, the first guide pipe 27 is connected to the first delivery hole 9, the second guide pipe 28 is connected to the second delivery hole 10, the third guide pipe 29 is connected to the third delivery hole 11 and the fourth guide pipe 30 is connected to the fourth delivery hole 12, and animal litter 2 delivered from each of the delivery holes 9-12 is sent out downward through the guide pipes 27-30 connected to the delivery holes 9-12.

Also, in the first to fourth guide pipes 27-30 there are disposed measuring devices 5 for each of the first to fourth guide pipes, that measure the amount of animal litter 2 sent out from the first to fourth guide pipes 27-30.

For this embodiment, the measuring devices 5 are constructed for measurement of the mass of the animal litter. The measuring devices used may have any desired construction so long as they can measure the mass of the animal litter 2 sent from the first to fourth guide pipes 27-30. For example, the construction may be such that the animal litter 2 send from the first to fourth guide pipes 27-30 is received in a pan and the animal litter 2 loaded on the pan is measured by measuring means, such as a load cell.

With each of the measuring devices 5, data for the mass of the animal litter 2 that has been sent from the first to fourth guide pipes 27-30 can be outputted to the controller. When the mass of the animal litter 2 that has been sent from the first to fourth guide pipes 27-30 reaches a predetermined mass, based on the output data from the measuring devices 5, the controller drives the opening and closing valves 21 mounted on the first to fourth delivery holes 9-12 to close the first to fourth delivery holes 9-12 and cutoff delivery of the animal litter 2.

On the bottom edge sides of the first and second guide pipes 27, 28, among the first to fourth guide pipes 27-30, there is disposed a first temporary holding hopper 31 that merges the downstream ends of the first and second guide pipes 27, 28 and temporarily houses and holds animal litter 2 from the first guide pipe 27 and animal litter 2 from the second guide pipe 28 in a mixed state.

Also, on the bottom edge sides of the third and fourth guide pipes 29, 30 there is disposed a second temporary holding hopper 32 that merges the downstream ends of the third and fourth guide pipes 29, 30 and temporarily houses and holds animal litter 2 from the third guide pipe 29 and animal litter 2 from the fourth guide pipe 30 in a mixed state.

The first temporary holding hopper 31 and second temporary holding hopper 32 have structures with the same size and shape.

The first and second temporary holding hoppers 31, 32 have the bottom edge sides of the first and second guide pipes 27, 28 or the bottom edge sides of the third and fourth guide pipes 29, 30 connected at the top edge, and they can hold animal litter 2 that has been delivered from each guide pipe into the interior space.

At the bottom ends of the first and second temporary holding hoppers 31, 32 there are provided discharge holes (not shown) that discharge the animal litter 2 held in the interior spaces of the temporary holding hoppers 31, 32 to the exterior, and deliver it into containers 6 situated on the conveying apparatus 7. Thus, the first temporary holding hopper 31 can send a mixture of animal litter 2 delivered from both the first delivery hole 9 and the second delivery hole 10, to the container 6, while the second temporary holding hopper 32 can send a mixture of the animal litter 2 delivered from both the third delivery hole 11 and fourth delivery hole 12, to the container 6.

In this apparatus 1, therefore, animal litter 2 can be simultaneously filled into two containers 6.

Furthermore, the bottom edge sides of the first and second temporary holding hoppers 31, 32 have a shape that gradually narrows toward the discharge holes in the direction of the lower end, and animal litter 2 in the interior space of the temporary holding hoppers 31, 32 moves in the direction of the discharge holes and can be stably discharged from the discharge holes.

Also, in each of the discharge holes of the first and second temporary holding hoppers 31, 32 there are mounted outlet tubes 33, 34 that guide animal litter 2, discharged from the discharge holes, toward the containers 6 on the conveying apparatus 7 that are to be filled with animal litter 2, and animal litter 2 is discharged from the openings on the downstream ends (bottom edge sides) of the outlet tubes 33, 34, through the openings above the containers 6, 6, allowing the animal litter 2 to be stably filled into the containers 6, 6.

In each of the first and second temporary holding hoppers 31, 32 there is disposed an opening and closing valve 35 that opens and closes each discharge hole, allowing adjustment of the timing for filling the animal litter 2 into the containers 6 to be filled. For this embodiment, the opening and closing valves 35 are designed to close the discharge holes while the animal litter 2 is being filled to the prescribed mass in the interior spaces of the first and second temporary holding hoppers 31, 32 and while the openings of the containers 6, 6 to be filled are being transported to the locations of the openings of the outlet tubes 33, 34, and to open the discharge holes only when the animal litter 2 is to be filled into the containers 6, 6.

The method of filling a container with animal litter according to the first embodiment will now be explained, using the apparatus 1.

In this filling method, the large-sized granules with predetermined particle diameters and the small-sized granules with smaller particle diameters than the large-sized granules in the animal litter 2 are supplied to the storage hopper 3, and animal litter 2 stored in the storage space 8 is delivered from the plurality of delivery holes 9-12 provided along the lengthwise direction of the storage space 8, and filled into the containers 6, 6 that are to be filled with the animal litter 2.

The basic flow for the filling method of this embodiment comprises a supply step in which the animal litter 2 is supplied to the storage space 8 of the hopper 3, a measuring step in which the animal litter 2 in the storage space 8 is delivered from each of the delivery holes 9-12 and the blending ratio between the large-sized granules and small-sized granules in the predetermined unit amount, delivered from the delivery holes 9-12, is measured, and a filling step in which the animal litter 2 is filled into the containers 6, 6 through the delivery holes 9-12 selected based on the measurement results from the measuring step.

In the supply step, the animal litter 2 produced in the production step is supplied into the storage space 8 of the storage hopper 3 by the feeder 4.

In the supply step, the animal litter 2 is allowed to freely drop from above the storage space 8 of the hopper 3, and in the storage space 8, a first region 38 in which the blending ratio of the small-sized granules with respect to the large-sized granules in a unit amount of the animal litter 2 is equal to or less than the predetermined blending ratio and a second region 39 in which the blending ratio of the small-sized granules with respect to the large-sized granules in a unit amount of the animal litter 2 is greater than the predetermined blending ratio, are formed in an arrangement along the lengthwise direction of the storage space 8.

As the animal litter 2 supplied to the storage space 8 of the hopper 3 in the supply step there may be used a known type of animal litter, such as sand prepared principally from a clay-like substance composed mainly of montmorillonite commonly known as bentonite, or a paper material or the like. Also, the form of the animal litter may be any of various forms so long as it is particulate, however, it is preferably pellet-like (essentially cylindrical) for the most part.

In addition, the particle diameter of the animal litter 2 may be basically the predetermined particle diameter.

However, the animal litter 2 supplied by the feeder 4 during the supply step may have some degree of error in particle diameter produced during molding in the production step, or it may undergo partial chipping or breaking before it is conveyed to the feeder, and therefore the animal litter 2 conveyed from the production step to the feeder does not need to have the same particle diameter.

That is, the animal litter 2 conveyed to the feeder 4 and supplied from the feeder 4 to the storage space 8 is a mixture of large-sized granules having the predetermined particle diameter (for example, about 2 to 10 mm) and small-sized granules having particle diameters that are smaller than the large-sized granules.

The large-sized granules naturally include those with the predetermined particle diameter, but also include particle diameters other than the predetermined particle diameter, within a range that is allowed as the predetermined particle diameter. Also, the amount of small-sized granules is basically greater than the total amount of large-sized granules (the total mass for this embodiment).

Supply of the animal litter 2 into the storage space 8 of the hopper 3 is accomplished through the supply pipe 25 of the feeder 4, and at the center location in the lengthwise direction of the storage space 8, the animal litter 2 is allowed to freely drop from above from the supply pipe 25 into the storage space 8 of the hopper 3, the animal litter 2 accumulating in a raised pile inside the storage space 8.

This causes formation in the storage space 8 of a first region 38 in which the blending ratio of the small-sized granules with respect to the large-sized granules in the unit amount of the animal litter 2 is equal to or less than the predetermined blending ratio, and a second region 39 in which the blending ratio of the small-sized granules with respect to the large-sized granules in the unit amount of the animal litter 2 is greater than the predetermined blending ratio, arranged in the lengthwise direction of the storage space 8.

Regarding formation of the first region 38 and the second region 39, as animal litter 2 supplied by freely dropping into the storage space 8 of the hopper 3 accumulates and is stored as a raised pile in the storage space 8, the large-sized granules of the animal litter 2 that have the predetermined particle diameter for the animal litter 2 roll down in the direction of both ends in the lengthwise direction of the storage space 8. Thus, the large-sized granules tend to easily collect in larger amounts at both ends in the lengthwise direction of the storage space 8.

On the other hand, the smaller particle diameter sand having smaller particle diameters than the large-sized granules does not move as much as the large-sized granules, and is therefore present in greater amounts at and near the center location in the lengthwise direction of the storage space 8 which is the dropping location, and the small-sized granules present at both ends in the lengthwise direction of the storage space 8 tend to be relatively fewer in number.

Consequently, the blending ratio of the large-sized granules and small-sized granules in a unit amount (a unit mass in the case of this embodiment) of the animal litter 2 in the storage space 8 of the hopper 3 tends toward a lower proportion of small-sized granules toward both ends in the lengthwise direction of the storage space 8.

The results of experimentation by the present inventors, described below, has demonstrated this fact that the blending ratio of the large-sized granules and small-sized granules in a unit amount in the animal litter 2 in the storage space 8 of the hopper 3 tends toward a lower proportion of small-sized granules toward both ends in the lengthwise direction of the storage space 8.

Figure 4:
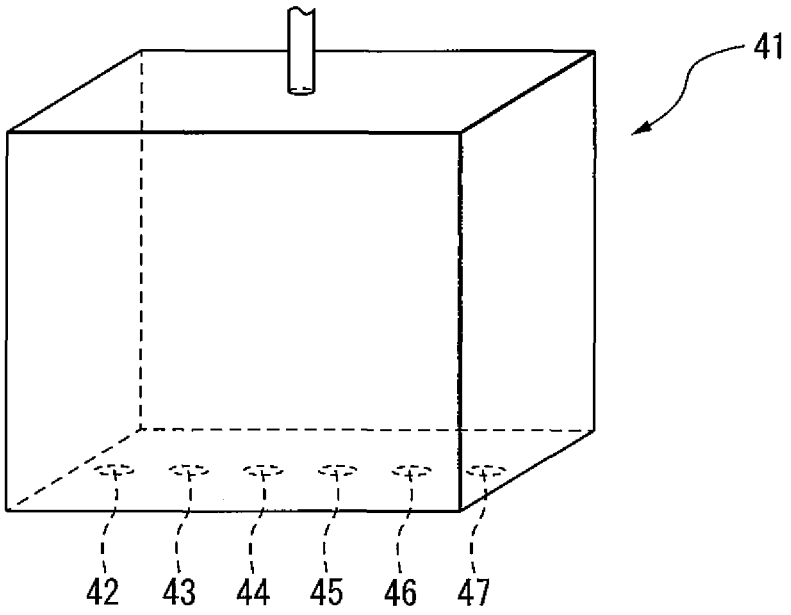
FIG. 4 is a diagram illustrating an apparatus used for experimentation on the blending ratio of large-sized granules and small-sized granules for unit amounts of animal litter.

Specifically, in order to confirm that the blending ratio of the large-sized granules and small-sized granules in a unit amount exhibits the aforementioned tendency, the present inventors conducted experimentation in which animal litter 2 was supplied by free dropping into a box 41 (corresponding to the hopper 3) having an essentially cuboid shape and an opening at the top, as shown in FIG. 4, and then animal litter 2 was delivered from each of 6 first to sixth delivery holes 42-47 formed at the bottom section of the box 41, and the blending ratio of large-sized granules and small-sized granules per unit amount in the animal litter 2 delivered from the delivery holes 42-47 was measured.

The box 41 used had a lengthwise direction length of 120 cm, a widthwise direction length of 20 cm and a height of 100 cm, and the hole diameter for the first to sixth delivery holes was 3 cm.

Supply of the animal litter 2 into the interior space of the box 41 was accomplished by allowing it to freely drop from a location at a height of 30 cm from the bottom of the interior space of the box 41, at a location corresponding to the center in the widthwise direction and the center in the lengthwise direction of the interior space of the box 41, so that the animal litter 2 accumulated in a raised pile in the interior space of the box 41.

Also, the animal litter 2 used was pellet-shaped granules of 2 mm or greater as the large-sized granules and granules of less than 2 mm as the small-sized granules, mixed to essential uniformity at 85 mass % of the large-sized granules and 15 mass % of the small-sized granules, and then supplied in an amount of 150 kg into the box 41.

The animal litter 2 was simultaneously delivered from the first to sixth delivery holes 42-47 and taken in 10 kg portions at every delivery hole as sample, and the sample taken from each delivery hole was reduced to 300 g using a reducer and the blending ratio of the large-sized granules and small-sized granules per unit amount was measured.

For measurement of the blending ratio of the large-sized granules and small-sized granules per unit amount in the sample reduced to 300 g, a sieve with a 2 mm aperture was used for sifting, producing large-sized granules remaining on the sieve and small-sized granules under the sieve, and the blending ratio of the large-sized granules and small-sized granules per unit amount was calculated based on the proportion of the respective masses of the granules on the sieve and the granules under the sieve.

The results are shown in Table 1.

TABLE 1

| Mixing proportion of small-sized granules (%) | | | | | |
|---|---|---|---|---|---|
| 1st delivery hole | 2nd delivery hole | 3rd delivery hole | 4th delivery hole | 5th delivery hole | 6th delivery hole |
| 10.1% | 14.5% | 16.6% | 17.1% | 14.0% | 11.3% |

As shown in Table 1, the animal litter 2 delivered from the box 41 has a gradually smaller blending ratio of small-sized granules per unit amount of animal litter delivered from the delivery hole at delivery holes closer to both ends in the lengthwise direction of the interior space of the box 41, and conversely it has a gradually larger ratio at the center in the lengthwise direction.

Therefore, the same event occurs for animal litter in the storage space 8 of the hopper 4, and the blending ratio of the large-sized granules and small-sized granules per unit amount of the animal litter 2 tends toward a gradually smaller blending ratio of the small-sized granules toward both ends in the lengthwise direction of the storage space 8.

Consequently, regarding the blending ratio of the large-sized granules and the small-sized granules in the predetermined unit amount for the animal litter 2 in the storage space 8 of the hopper 3, based on the predetermined blending ratio, it can be separated into a first region 38 in which the blending ratio of small-sized granules with respect to large-sized granules in a unit amount of the animal litter 2 is equal to or less than the predetermined blending ratio and a second region 39 in which the predetermined blending ratio of the small-sized granules is exceeded.

Also, the first region 38 and second region 39 are formed in a manner arranged in the lengthwise direction of the storage space 8. Basically, the first region 38 is formed on both ends in the lengthwise direction of the storage space 8, while the second region 39 is formed at or near the center location in the lengthwise direction of the storage space 8 at the location where the animal litter 2 is dropped from the feeder 4.

The blending ratio of the large-sized granules and the small-sized granules in a unit amount may be set as desired depending on the type and size of the animal that is to use the animal litter, and in the case of a medium-sized cat, for example, the blending ratio of the large-sized granules and small-sized granules in a unit amount may be about 10% to 20% small-sized granules in the unit amount.

The blending ratio of the small-sized granules with respect to the large-sized granules in a unit amount of the animal litter 2 (the unit mass in this case) in the animal litter 2 supplied into the storage space 8 of the hopper 3 during the supply step is preferably adjusted before carrying out the supply step, so that the predetermined target blending ratio is obtained.

Thus, when animal litter 2 is being delivered and filled into containers 6 from both the first region 38 and the second region 39 in the subsequent filling step, and the same mass of animal litter 2 has been delivered and mixed from the delivery hole that delivers animal litter 2 in the first region 38 and the delivery hole that delivers animal litter 2 in the second region 39, it is easier for the blending ratio of the large-sized granules and small-sized granules in a unit amount of the animal litter 2 to be a blending ratio that is either the predetermined target blending ratio, or in an allowable range near the target blending ratio.

Consequently, there is essentially no need to newly adjust the amount of animal litter from the delivery hole that delivers animal litter 2 in the first region 38 and the amount of animal litter 2 from the delivery hole that delivers animal litter 2 in the second region, in order to obtained the target blending ratio for the blending ratio of the small-sized granules with respect to the large-sized granules in the unit amount of animal litter 2.

Furthermore, by delivering the same amounts of animal litter 2 from the delivery holes that deliver animal litter 2 of the first region 38 and the delivery holes that deliver animal litter 2 of the second region 39, it is possible to minimize variation in the ranges of the first region 38 and the second region 39, since the animal litter 2 in the storage space 8 of the hopper 3 moves downward as the entire animal litter 2 moves downward in the storage space 8 by delivery. This is advantageous in that it allows stable delivery of the animal litter 2 of the first region 38 or second region 39 that is to delivered through the delivery holes 9-12.

In the measuring step, animal litter 2 in the storage space 8 of the hopper 3 is delivered through the first to fourth delivery holes 9-12 and just a predetermined unit amount is taken as a sample, measuring the blending ratio of the large-sized granules and small-sized granules in the predetermined unit amount delivered through the first to fourth delivery holes 9-12.

The measuring step may be carried out either constantly or at prescribed time intervals. Also, in the measuring step of this embodiment, it is sufficient to be able to confirm which region contained the animal litter delivered through the first to fourth delivery holes.

For this embodiment, the blending ratio of the large-sized granules and small-sized granules per unit mass is measured in the animal litter 2 delivered from the first to fourth delivery holes 9-12. A known method may be used for measurement of the blending ratio of the large-sized granules and small-sized granules in the unit mass.

For example, animal litter 2 delivered from the first to fourth delivery holes 9-12 may be taken as samples in the predetermined mass (for example, 10 kg) from each of the delivery holes 9-12, and each sample reduced to the prescribed mass (for example, 300 g) with a reducer, while the reduced sample may be sifted with a sieve having an aperture allowing the large-sized granules to remain on the sieve and the small-sized granules to pass under the sieve. Next, the mass of the entire large-sized granules on the sieve and the mass of the entire small-sized granules under the sieve may be measured, and the blending ratio of the large-sized granules and small-sized granules in the unit mass may be calculated from the mass ratio.

In the filling step, the animal litter 2 is filled into the containers 6, 6 through selected delivery holes, based on the measurement results for the blending ratio of the large-sized granules and small-sized granules in the unit mass at the first to fourth delivery holes 9-12 during the measuring step.

More specifically, in the filling step, a delivery hole that can deliver animal litter 2 of the first region 38 and a delivery hole that can deliver animal litter 2 of the second region 39 are selected based on the measurement results from the measuring step, and the animal litter 2 from each of the selected delivery holes is delivered at least once each in the predetermined amount into the containers 6, 6 in such a manner that the blending ratio of the large-sized granules and small-sized granules in the unit mass is the predetermined target blending ratio.

During the supply step, as explained above, there are formed in the animal litter 2 in the storage space 8 of the hopper 3 a first region 38 in which the blending ratio of the large-sized granules and small-sized granules in the unit amount is equal to or less than the predetermined blending ratio, and a second region 39 in which the blending ratio of the large-sized granules and small-sized granules in the unit amount is greater than the predetermined blending ratio.

In the case of this embodiment, as shown in FIG. 1 and FIG. 2, the animal litter 2 in the first region 38 can be delivered to the exterior of the hopper 3 through the first and fourth delivery holes 9, 12 located on both sides in the lengthwise direction of the storage space 8 of the hopper 3. On the other hand, animal litter 2 in the second region 39 can be delivered to the exterior of the hopper 3 through the second and third delivery holes 10, 11 located nearer the center location in the lengthwise direction of the storage space 8 than the first and fourth delivery holes 9, 12.

Consequently, animal litter 2 may be delivered at least once from the first delivery hole 9 or fourth delivery hole 12 and at least once from the second delivery hole 10 or third delivery hole 11, and filled into the container 6 that is to be filled with animal litter 2.

This results in an almost constant blending ratio of the large-sized granules and small-sized granules in the unit amount of the animal litter 2 filled into the containers 6, 6, though with a certain degree of variation within the allowable range, and hence there is essentially no difference in performance of the animal litter 2 as a whole filled into each of the containers to be filled with the animal litter 2, regardless of the container.

Particularly in the case of this embodiment, the first guide pipe 27 connected to the first delivery hole 9 and the second guide pipe 28 connected to the second delivery hole 10 are connected to the first temporary holding hopper 31, while the third guide pipe 29 connected to the third delivery hole 11 and the fourth guide pipe 30 connected to the fourth delivery hole 12 are connected to the second temporary holding hopper 32. The apparatus 1 of this embodiment, therefore, has a construction where the delivery hole allowing delivery of animal litter 2 of the first region 38 and the delivery hole allowing delivery of the animal litter 2 of the second region 39 are already selected.

As a result, since animal litter 2 discharged from the first temporary holding hopper 31 or the second temporary holding hopper 32 becomes a mixture of animal litter 2 delivered once each from the first region 38 and second region 39, the animal litter 2 that has passed through the first and second temporary holding hoppers 31, 32 and filled the containers 6, 6 includes animal litter 2 that has been automatically delivered once each from the first region 38 and second region 39.

Furthermore, for this embodiment, the animal litter 2 held and temporarily stored in the first temporary holding hopper 31 or the second temporary holding hopper 32 is set to an amount that in one shot fills the prescribed capacity of the containers 6, 6. Consequently, filling of the animal litter 2 into the containers 6, 6 is carried out once by either filling from the first temporary holding hopper 31 or filling from the second temporary holding hopper 32.

Also, delivery of the animal litter 2 from the first to fourth delivery holes 9-12 is carried out essentially simultaneously at all of the delivery holes 9-12. When the blending ratio of the large-sized granules and small-sized granules in the unit amount of the animal litter 2 to be supplied to the hopper 3 in the supply step has been preadjusted to the predetermined target blending ratio prior to the supply step, equal amounts of animal litter 2 are delivered from the first to fourth delivery holes 9-12. This allows all of the animal litter 2 in the storage space 8 to move directly downward as the animal litter 2 is delivered, so that variation in the ranges of the first region 38 and second region 39 can be minimized.

Incidentally, the masses of the animal litter 2 of the first region 38 and the animal litter 2 of the second region 39 that are delivered from the first and second delivery holes 9, 10 may be adjusted so that the large-sized granules and small-sized granules in the unit amount of the animal litter 2 held in the interior space of the first temporary holding hopper 31 can be filled into the container 6 in the predetermined target blending ratio.

Since the masses of the animal litter 2 delivered from the first and second delivery holes 9, 10 are each calculated by the measuring device 5, when measurement by the measuring device 5 has indicated that the masses of the animal litter 2 delivered from the first and second delivery holes 9, 10 have reached amounts matching the predetermined target blending ratio for the large-sized granules and small-sized granules per unit mass, the opening and closing valve 21 of the first delivery hole 9 and/or second delivery hole 10 is closed via the controller to cutoff delivery of the animal litter.

Similarly, for the animal litter 2 held in the interior space of the second temporary holding hopper 32, the masses of the animal litter 2 of the first region 38 and animal litter 2 of the second region 39 delivered from the third and fourth delivery holes 11, 12 may be adjusted to allow filling into the container 6 after adjusting the blending ratio of the large-sized granules and small-sized granules per unit amount to the predetermined target blending ratio.

Thus, in this method of filling a container with animal litter animal litter, in the supply step in which the animal litter 2 is supplied into the storage space 8 of the hopper 3, the animal litter 2 is allowed to freely drop from above the storage space 8 of the hopper 3 to accumulate in a raised pile, thereby forming the first region 38 and second region 39 with mutually different blending ratios of large-sized granules and small-sized granules per unit amount in the animal litter 2 in the storage space 8.

Also, in the filling step in which animal litter 2 is filled into the containers 6, 6, delivery holes capable of delivering the animal litter 2 of the first region 38 and of the second region 39 are selected, and the animal litter 2 is delivered in the predetermined amount at least once each from each of the selected delivery holes, filling the containers 6, 6 so that the large-sized granules and small-sized granules in the unit amount are in the predetermined target blending ratio.

This mixes the animal litter 2 of the first region 38 and the animal litter 2 of the second region 39, to adjust the blending ratio of the large-sized granules and small-sized granules per unit amount of the animal litter 2 while allowing the container to be easily filled with the predetermined blending ratio.

In addition, since the animal litter 2 of the first region 38 and the animal litter 2 of the second region 39 are mixed to adjust the blending ratio of the large-sized granules and small-sized granules per unit amount in all of the containers 6, 6, it is possible to accomplish stable filling with an essentially constant blending ratio of the large-sized granules and small-sized granules.

For the first embodiment, in the filling step, guide pipes attached to each of the delivery holes of the hopper were used to simultaneously deliver animal litter of the first region and animal litter of the second region from two different delivery holes and fill it into the containers, thereby completely filling the containers with the animal litter.

However, the second embodiment described below has a different filling step from the first embodiment.

Figure 5:
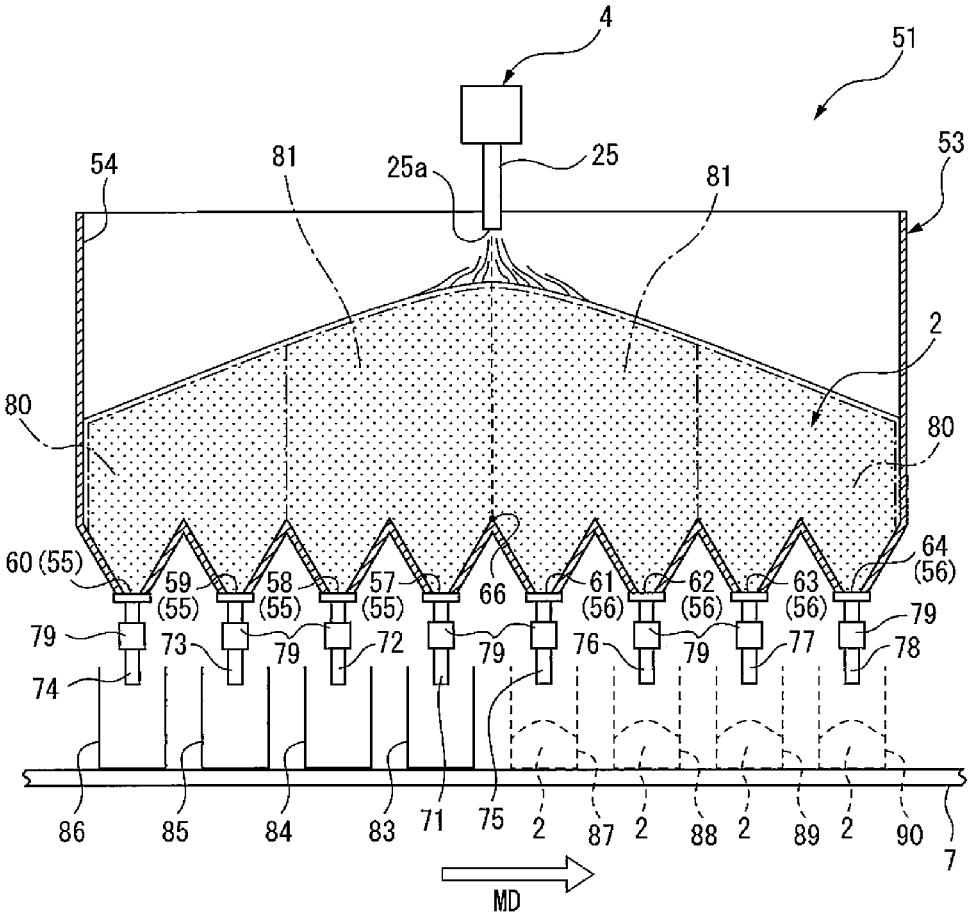
FIG. 5 is a partial cut-away front view schematically showing an example of an apparatus for carrying out a second embodiment of the method of filling animal litter into containers according to the invention. Shown here is the state during the first stage of the filling step.
Figure 6:
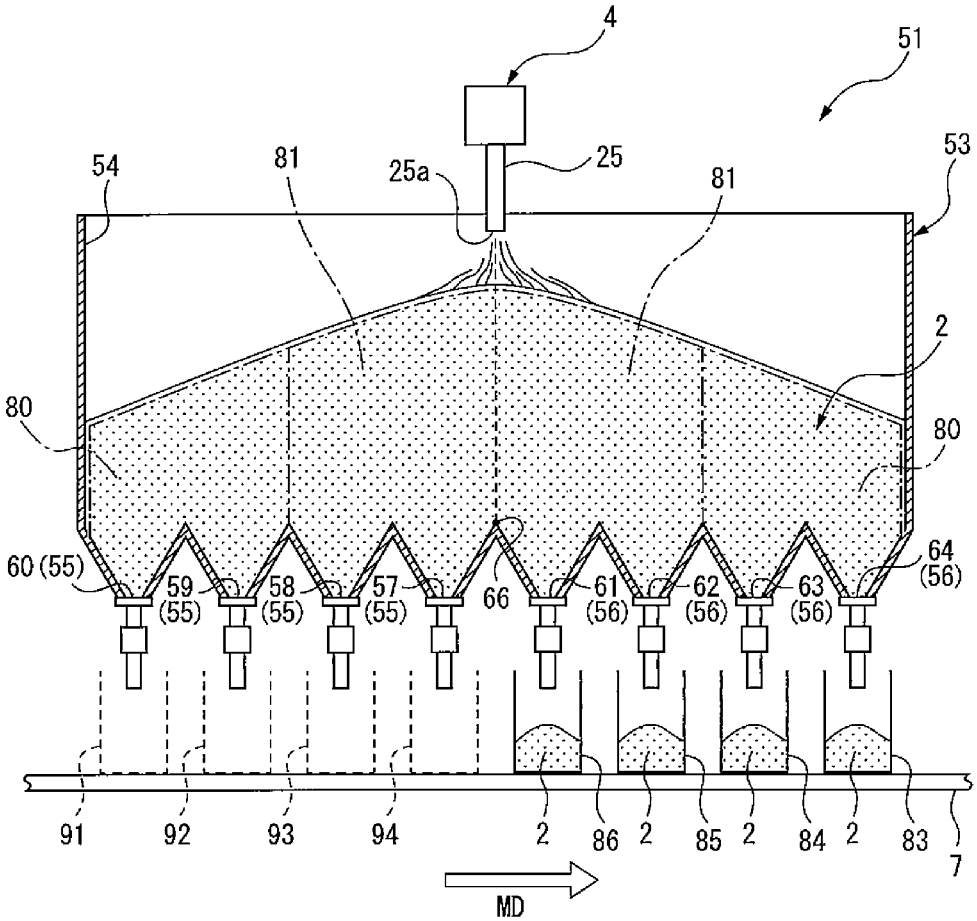
FIG. 6 is a partial cut-away front view schematically showing an example of an apparatus for carrying out a second embodiment of the method of filling animal litter into containers according to the invention. Shown here is the state during the second stage of the filling step.

FIG. 5 and FIG. 6 show an example of an apparatus for carrying out the second embodiment of the method of filling animal litter into a container according to the invention.

The apparatus 51 differs from the first embodiment in the number of delivery holes provided in the hopper 53, there being formed eight delivery holes 57-64 in the apparatus 51. Thus, animal litter can be simultaneously filled into eight containers.

When the supply pipe 25 of the feeder 4 supplies animal litter 2 into the storage space 54 of the hopper 53, the eight delivery holes 57-64 are divided into two delivery hole groups 55, 56, using the dropping target location of the animal litter 2, i.e. the center in the widthwise direction and the center location in the lengthwise direction of the storage space 54 as the reference point 66. In other words, the hopper 53 has a construction comprising four delivery holes disposed along the direction of one end (the left side in FIG. 5 and FIG. 6) in the lengthwise direction of the storage space 54 from the reference point 66, i.e. a first delivery hole group 55 comprising first to fourth delivery holes 57-60 at one end and four delivery holes disposed in the direction of the other end (the right side in FIG. 5 and FIG. 6), i.e. a second delivery hole group 56 comprising first to fourth delivery holes 61-64 on the other end.

The first delivery hole group 55 is disposed with a first delivery hole 57 at one end located first, a second delivery hole 58 at one end located second, a third delivery hole 59 at one end located third and a fourth delivery hole 60 at one end located fourth from the reference point 66 side, in that order from a location near the reference point 66 in the direction away from the reference point 66.

Also, the second delivery hole group 56 is disposed with a first delivery hole 61 on the other end located first, a second delivery hole 62 on the other end located second, a third delivery hole 63 on the other end located third and a fourth delivery hole 64 on the other end located fourth from the reference point 66 side, in that order from a location near the reference point 66 in the direction away from the reference point 66.

Each delivery hole of the first delivery hole group 55 and each delivery hole of the second delivery hole group 56 is disposed at a line symmetrical location around a vertical straight line passing through the reference point 66.

Also, the eight delivery holes 57-64 are disposed at mutually equal spacings and arranged on a straight line, at the center in the widthwise direction of the hopper 53 along the lengthwise direction of the storage space 54 of the hopper 53.

The eight delivery holes 57-64 are disposed essentially equidistantly across the lengthwise direction of the hopper 53.

For this second embodiment, the apparatus 51 is not provided with a guide pipe as in the first embodiment, or a hopper for temporary storage, and in the respective delivery holes 57-64 there are directly mounted outlet tubes 71-78 that guide the delivered animal litter 2 toward the openings above the containers that are to be filled, for stable filling of the animal litter 2 into the containers.

There are also mounted on each of the outlet tubes 71-78 a measuring device 79 that measures mass of the animal litter 2 delivered from the delivery holes 57-64 to which the outlet tubes 71-78 are connected.

The construction of the apparatus 51 other than the hopper and delivery holes, i.e. respective constructions of the feeder, measuring device and conveyor, and the structure of the animal litter, is essentially the same as an apparatus for carrying out the filling method of the first embodiment, and they are therefore assigned the same symbols and will not be explained in detail again.

The method of filling a container with animal litter according to this embodiment will now be explained, using the apparatus 51.

In the filling method of this embodiment, similar to the first embodiment, the large-sized granules with predetermined particle diameters and the small-sized granules with smaller particle diameters than the large-sized granules in the animal litter 2 are supplied to the storage hopper 53, and animal litter 2 stored in the storage space 54 is delivered from the plurality of delivery holes 57-64 provided along the lengthwise direction of the storage space 54, and filled into containers that are to be filled with the animal litter 2.

The basic flow for the filling method of this embodiment, similar to the first embodiment, comprises a supply step in which the animal litter 2 is supplied to the storage space 54 of the hopper 53, a measuring step in which the animal litter 2 in the storage space 54 is delivered from each of the delivery holes 57-64 and the blending ratio between the large-sized granules and small-sized granules in the predetermined unit amount, delivered from the delivery holes 57-64, is measured, and a filling step in which the animal litter 2 is filled into the containers through the delivery holes selected based on the measurement results from the measuring step.

The supply step is basically the same as first embodiment, the animal litter 2 produced in the production step being allowed to freely drop at the center in the widthwise direction of the storage space 54 of the hopper 53 and at the center location in the lengthwise direction through the supply pipe 25 of the feeder 4, and the animal litter 2 accumulating into a raised pile in the storage space 54. This causes formation of a first region 80 in which the blending ratio of the small-sized granules with respect to the large-sized granules in the predetermined unit amount, or in the unit mass in this case, of the animal litter 2, is equal to or less than the predetermined blending ratio and a second region 81 in which the blending ratio of the small-sized granules with respect to the large-sized granules in the unit amount of the animal litter 2 is greater than the predetermined blending ratio, arranged in the lengthwise direction of the storage space 54. Similar to the first embodiment, the animal litter 2 in the storage space 54 has the first region 80 formed on both ends in the lengthwise direction and the second region 81 formed on the center side of the lengthwise direction of the storage space 54.

Of the first delivery hole group 55 in the hopper 53, the two delivery holes near the reference point 66, i.e. the first delivery hole 57 close to one end and the second delivery hole 58 close to one end, are able to deliver the animal litter 2 of the second region 81. Also, of the first delivery hole group 55, the two delivery holes near the edge in the lengthwise direction of the hopper 53, i.e. the third delivery hole 59 close to one end and the fourth delivery hole 60 close to one end, are able to deliver the animal litter 2 of the first region 80.

On the other hand, of the second delivery hole group 56 in the hopper 53, the two delivery holes near the reference point 66, i.e. the first delivery hole 61 close to the other end and the second delivery hole 62 close to the other end, are able to deliver the animal litter 2 of the second region 81. Also, of the second delivery hole group 56, the two delivery holes near the edge in the lengthwise direction of the hopper 53, i.e. the third delivery hole 63 close to the other end and the fourth delivery hole 64 close to the other end, are able to deliver the animal litter 2 of the first region 80.

For this embodiment as well, similar to the first embodiment, the blending ratio of the small-sized granules with respect to the large-sized granules in a unit mass of the animal litter 2, supplied into the storage space 54 of the hopper 53 during the supply step, is preferably adjusted before carrying out the supply step, so that the predetermined target blending ratio is obtained.

The steps are essentially carried out in the same manner as the first embodiment, except that in the measuring step the blending ratio of the large-sized granules and small-sized granules per predetermined unit amount is measured for the animal litter 2 to be delivered through each of the eight delivery holes 57-64, and therefore they will not be explained in detail again.

In the filling step, first animal litter 2 is delivered and filled into the first to fourth containers 83-86 disposed at the respective delivery holes 57-60, from the first to fourth delivery holes 57-60 of the first delivery hole group 55.

Next, animal litter 2 is delivered and filled into the first to fourth containers 83-86 that have completed filling of the animal litter 2 from each of the injection holes at the first to fourth locations from the reference point 66 side of the first delivery hole group 55, i.e. the first to fourth delivery holes 57-60, through the respective injection holes at the fourth to first locations from the reference point 66 side of the second delivery hole group 56, i.e. the fourth to first delivery holes 64-61.

More specifically, as shown in FIG. 5, in the first stage animal litter 2 from the first delivery hole 57 is filled into the first container 83, animal litter 2 from the second delivery hole 58 is filled into the second container 84, animal litter 2 from the third delivery hole 59 is filled into the third container 85 and animal litter 2 from the fourth delivery hole 60 is filled into the fourth container 86. At this time, the amount of animal litter 2 filled into the first to fourth containers 83-86 through the first delivery hole group 55 is about half of the prescribed amount necessary to fill the first to fourth containers 83-86.

Next, the first to fourth containers 83-86 are shifted by the conveying apparatus 7 from the position where the first delivery hole group 55 of the hopper 53 is disposed to a position where the second delivery hole group 56 is disposed.

As shown in FIG. 6, in the second stage, animal litter 2 from the fourth delivery hole 64 is filled into the first container 83, animal litter 2 from the third delivery hole 63 is filled into the second container 84, animal litter 2 from the second delivery hole 62 is filled into the third container 85 and animal litter 2 from the first delivery hole 61 is filled into the fourth container 86. At this time, the amount of animal litter 2 filled into the first to fourth containers 83-86 through the second delivery hole group 56 is about half of the prescribed amount necessary to fill the first to fourth containers 83-86. Consequently, the first to fourth containers 83-86 become filled with the necessary prescribed amount upon completion of the second stage.

Here, in the first stage of the filling step, the animal litter 2 in the second region 81, of the animal litter 2 in the storage space 54 of the hopper 53, is filled into the first and second containers 83, 84, while the animal litter 2 of the first region 80 is filled into the third and fourth containers 85, 86.

In the second stage, the animal litter 2 in the first region 80, of the animal litter 2 in the storage space 54 of the hopper 53, is filled into the first and second containers 83, 84, while the animal litter 2 of the second region 81 is filled into the third and fourth containers 85, 86.

As a result, animal litter 2 is delivered and filled into the first to fourth containers 83-86 in the predetermined amount once each from delivery holes that can deliver animal litter 2 of the first region 80 and delivery holes that can deliver animal litter 2 of the second region 81.

Here, animal litter 2 delivered from the first and second delivery hole group 55, 56 tends to have a blending ratio of the large-sized granules and small-sized granules per unit amount of the animal litter 2, where the blending ratio of small-sized granules is gradually lower away from the reference point 66.

For the first delivery hole group 55, therefore, the animal litter 2 delivered from the first delivery hole 57 has the highest blending ratio of small-sized granules, followed in decreasing order of small-sized granule blending ratio by the animal litter 2 delivered from the second delivery hole 58, the animal litter 2 delivered from the third delivery hole 59 and the animal litter 2 delivered from the fourth delivery hole 60. On the other hand, for the second delivery hole group 56, the animal litter 2 delivered from the first delivery hole 61 has the highest blending ratio of small-sized granules, followed in decreasing order of small-sized granule blending ratio by the animal litter 2 delivered from the second delivery hole 62, the animal litter 2 delivered from the third delivery hole 63 and the animal litter 2 delivered from the fourth delivery hole 64.

In the first stage of the filling step, therefore, of the first to fourth containers 83-86, the animal litter 2 filled into the first container 83 has the highest blending ratio of small-sized granules per unit mass followed, in decreasing order of small-sized granule blending ratio per unit mass of animal litter 2, by the animal litter 2 filled into the second container 84, the animal litter 2 filled into the third container 85 and the animal litter 2 filled into the fourth container 86.

In the second stage of the filling step, on the other hand, of the first to fourth containers 83-86, the animal litter 2 filled into the first container 83 has the lowest blending ratio of small-sized granules followed, in increasing order of small-sized granule blending ratio, by the animal litter 2 filled into the second container 84, the animal litter 2 filled into the third container 85 and the animal litter 2 filled into the fourth container 86.

As a result, the animal litter 2 filled into the first to fourth containers 83-86 has essentially the same blending ratio of large-sized granules and small-sized granules per unit amount in each of the containers 83-86. It is therefore possible to maintain essentially constant performance for the entire animal litter 2 filled into each of the containers 83-86.

Incidentally, although animal litter 2 is filled from the first delivery hole group 55 into the first to fourth containers 83-86 in the first stage of the filling step, the second delivery hole group 56 may also at this time supply animal litter 2 to the other four containers 87-90 that have already completed the first stage (indicated by broken lines in FIG. 5), as shown in FIG. 5.

Similarly, although animal litter 2 is filled from the second delivery hole group 56 into the first to fourth containers 61-64 in the second stage of the filling step, the first delivery hole group 55 may also at this time supply animal litter 2 to the other four containers 91-94 that have not yet been filled with animal litter 2 (indicated by broken lines in FIG. 6), as shown in FIG. 6.

This will allow simultaneous delivery of animal litter 2 in the first region 80 and second region 81 through the eight delivery holes 57-64 into the eight containers in equal amounts (equal masses in this case), to simultaneously fill each container with the animal litter 2.

Thus, since the first delivery hole group 55 and second delivery hole group 56 can fill animal litter into a plurality of containers in order in a flow production manner, it is highly advantageous for filling animal litter 2 into large-volume containers.

Moreover, since animal litter 2 is delivered simultaneously and in equal masses from all of the delivery holes 57-64, such that delivery of the animal litter 2 from the storage space 54 of the hopper 53 takes place while the entire animal litter 2 in the storage space 54 continues to move downward, it is possible to minimize variation within the ranges of the first region 80 and the second region 81. This allows stable delivery of the animal litter 2 of the first region 80 or second region 81 that is to be delivered through the respective delivery holes 57-64.

Thus, in the method of filling a container with animal litter according to the second embodiment, it is possible to obtain basically the same effect as the filling method of the first embodiment. In addition, since the first delivery hole group 55 and second delivery hole group 56 can fill animal litter 2 into a plurality of containers in order in a flow production manner, as mentioned above, it is suitable for filling animal litter into large-volume containers. Furthermore, the blending ratio of the large-sized granules and small-sized granules in the animal litter 2 to be filled into each container is less likely to be different for each container, allowing stable, uniform performance to be maintained for the entire animal litter 2 to be filled into the containers.

In addition, it can be carried out using an apparatus having a relatively simple construction compared to the apparatus used to carry out the filling method of the first embodiment.

In the method of filling a container with animal litter according to the first and second embodiments, the filling step essentially determines the combination of delivery holes that deliver animal litter of the first region and delivery holes that deliver animal litter of the second region into one container.

In the filling method according to a third embodiment now to be described, the delivery holes that deliver animal litter of the first region and delivery holes that deliver animal litter of the second region are selected as desired in the filling step based on the measurement results from the measuring step, so that the large-sized granules and small-sized granules per unit amount are in the predetermined target blending ratio.

Figure 7:
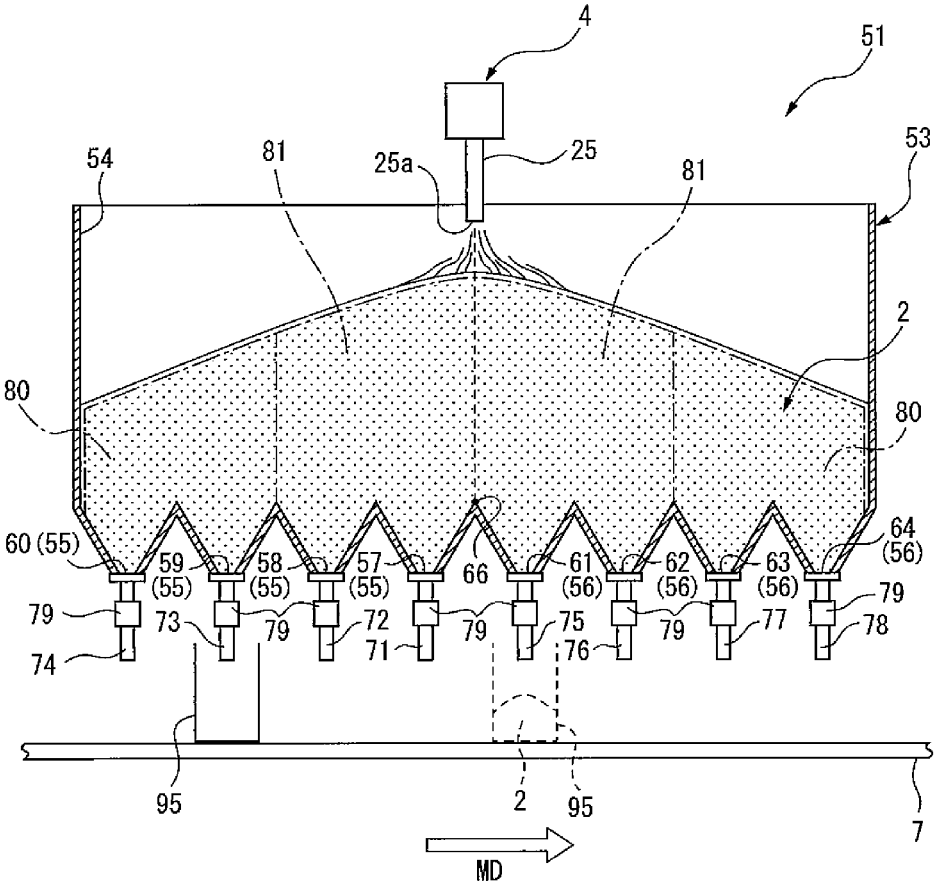
FIG. 7 is a partial cut-away front view schematically showing an example of an apparatus for carrying out a third embodiment of the method of filling animal litter into containers according to the invention.

FIG. 7 shows an example of an apparatus used to carry out the third embodiment of the method of filling a container with animal litter according to the invention, the apparatus having essentially the same construction as the second embodiment. This apparatus therefore has the same symbols as the apparatus of the second embodiment, and they will not be described in detail again.

The method of filling a container with animal litter according to this embodiment will now be explained, using the apparatus 51.

The basic flow for the filling method of this embodiment, similar to the second embodiment, comprises a supply step in which the animal litter 2 is supplied to the storage space 54 of the hopper 53, a measuring step in which the animal litter 2 in the storage space 54 is delivered from each of the delivery holes 57-64 and the blending ratio between the large-sized granules and small-sized granules in the predetermined unit amount, delivered from the delivery holes 57-64, is measured, and a filling step in which the animal litter 2 is filled into the containers through the delivery holes selected based on the measurement results from the measuring step.

The supply step and measuring step are essentially the same as for the second embodiment and therefore will not be described in detail again.

In the filling step, initially, as the first stage, animal litter 2 is filled into the containers 95 through delivery holes that are either the delivery holes 59, 60, 63, 64 that can deliver animal litter of the first region 80 or the delivery holes 57, 58, 61, 62 that can deliver animal litter of the second region 81, of the animal litter 2 in the storage space 54 of the hopper 53.

At this time, the blending ratio of the large-sized granules and small-sized granules per unit amount (unit mass in this case) for the animal litter 2 delivered from each of the delivery holes 57-64 is determined beforehand in the measuring step. Thus, in order for the large-sized granules and small-sized granules per unit amount to be in the predetermined target blending ratio, delivery holes can be selected that are able to deliver animal litter with the prescribed blending ratio of large-sized granules and small-sized granules per unit amount that is to be filled into the containers 95 in the subsequent step.

Also, as the second stage, each container 95 that has completed filling in the first stage is moved by the conveying apparatus 7 to a location allowing it to be filled with animal litter from the selected delivery hole, and animal litter is filled through that selected delivery hole.

When the animal litter 2 of the first region 80 has been filled into the container 95 in the first stage, basically the animal litter 2 of the second region 81 is filled into the container 95 in the second stage. Conversely, when the animal litter 2 of the second region 81 has been filled into the container 95 in the first stage, basically the animal litter 2 of the first region 80 is filled into the container 95 in the second stage. In the case illustrated in FIG. 7, animal litter 2 of the first region 80 is filled into the container 95 through the third delivery hole 59 during the first stage, and animal litter 2 of the second region 81 is filled through the first delivery hole 61 during the second stage.

Thus, it is possible to fill the animal litter 2 so that the large-sized granules and small-sized granules are in the target blending ratio in the container 95, or in a blending ratio within the allowable range, per unit amount.

Thus, in the method of filling a container with animal litter according to the third embodiment, it is possible to obtain basically the same effect as the filling method of the first embodiment.

In addition to this, it is possible to freely select appropriate delivery holes so that the large-sized granules and small-sized granules per unit amount of the animal litter 2 are in the target blending ratio, based on the measurement results from the measuring step. This provides an advantage in that the animal litter 2 to be filled into the containers 95 can be relatively easily adjusted to the target blending ratio for large-sized granules and small-sized granules per unit amount of the animal litter 2.

Although four delivery holes were provided in the hopper 3 for the first embodiment described above, the number of delivery holes may be two, three, or 5 or more delivery holes, so long as animal litter of the first region and animal litter of the second region can fill one container from the animal litter in the storage space of the hopper, and the predetermined target blending ratio can be obtained for the large-sized granules and small-sized granules per unit amount.

Similarly, although eight delivery holes were provided in the hopper 53 for the second embodiment described above, the number of delivery holes may be two or seven or nine or more delivery holes, so long as animal litter of the first region and animal litter of the second region can fill one container from the animal litter in the storage space of the hopper, and the predetermined target blending ratio can be obtained for the large-sized granules and small-sized granules per unit amount.

Also, in order to determine the first region and second region for the first and second embodiments, the determination was made according to the blending ratio of the small-sized granules with respect to the large-sized granules per unit mass, based on the unit mass of animal litter. However, the first region and second region may be determined based on the unit volume as the unit amount. In addition, the amount of animal litter to be delivered from each delivery hole in the filling step, or the amount sifted in the measuring step, may be determined as amounts based on volume.

For the first and second embodiments, animal litter 2 is delivered once each from the first regions 38, 80 and second regions 39, 81 in the filling step to fill the containers with animal litter 2. However, the filling step may instead fill the containers with animal litter of the first region and animal litter of the second region two or more times each, so long as the large-sized granules and small-sized granules can be in the predetermined target blending ratio per unit amount. During this time, the number of times the animal litter of the first region is filled into the container and the number of times the animal litter of the second region is filled into the containers does not necessarily need to be the same.

In addition, for the first embodiment the guide pipes 27-30 are provided for the respective delivery holes 9-12, and animal litter 2 that has been delivered from two delivery holes, namely a delivery hole that delivers the animal litter 2 of the first region 38 and a delivery hole that delivers the animal litter 2 of the second region 39, is housed and mixed in temporary holding hoppers 31, 32, after which it is filled into respective containers 6, 6 that are to be filled.

However, animal litter may be delivered from the delivery hole that delivers animal litter of the first region and the delivery hole that delivers animal litter of the second region, toward the respective containers, and animal litter may thus be directly filled into the containers.

For the first and second embodiments, the hoppers 3, 53 comprise a plurality of delivery holes arranged in a straight line along the lengthwise direction of the storage spaces 8, 54, however, the positions of the delivery holes do not necessarily need to be arranged in a straight line along the lengthwise direction of the storage space so long as there are delivery holes that can deliver animal litter of the first region and delivery holes that can deliver animal litter of the second region.

For the second embodiment, the animal litter 2 is delivered in the same amount and simultaneously from all of the delivery holes 57-64 in the filling step, however, the animal litter to be delivered from the delivery holes does not need to be in the same amount, and the timing of delivery also does not necessarily need to be simultaneous.

EXPLANATION OF SYMBOLS

2 Animal litter
3, 53 Hoppers
6, 83-94 Containers
8, 54 Storage spaces
9-12, 57-64 Delivery holes
38, 80 First regions
39, 81 Second regions
55 First delivery hole group
56 Second delivery hole group
66 Reference point

The invention claimed is:

1. A method of filling a container with animal litter, wherein animal litter including large-sized granules having predetermined particle diameters and small-sized granules having particle diameters smaller than the large-sized granules is supplied to a storage hopper having a storage space extending in one horizontal direction, and the animal litter stored in the storage space is delivered from a plurality of delivery holes including one or more first region delivery holes provided in a first region formed in the storage space and one or more second region delivery holes provided in a second region formed in the storage space, the plurality of delivery holes being provided along a lengthwise direction of the storage space on a bottom edge side of the hopper, and filled into containers that are to be filled, the method comprising a supply step in which the animal litter is supplied into the storage space of the hopper, a measuring step in which the animal litter in the storage space is delivered from each of the plurality of delivery holes and blending ratios of the large-sized granules and the small-sized granules per a predetermined unit amount of the animal litter delivered from each of the plurality of delivery holes is measured, and a filling step in which the animal litter is filled into the containers through a delivery hole selected from the plurality of delivery holes based on measurement results obtained in the measuring step, wherein in the supply step, the animal litter is freely dropped from above the storage space of the hopper, so that the first region and the second region are formed in the storage space aligning in the lengthwise direction of the storage space, and the animal litter in the first region has a first blending ratio of the small-sized granules with respect to the large-sized granules per the predetermined unit amount of the animal litter which is equal to or less than a predetermined blending ratio, and the animal litter in the second region has a second blending ratio of the small-sized granules with respect to the large-sized granules per the predetermined unit amount of the animal litter which is greater than the predetermined blending ratio, and in the filling step, the one or more first region delivery holes among the plurality of delivery holes that deliver the animal litter from the first region and the one or more second region delivery holes among the plurality of delivery holes that deliver the animal litter from the second region are selected based on the measurement results obtained in the measuring step, and the animal litter is delivered by a predetermined amount from each of the selected delivery holes at least once each and filled into the containers, so that each of the containers has the large-sized granules and small-sized granules in a predetermined target blending ratio per the predetermined unit amount of the animal litter.

2. The method of filling a container with animal litter according to claim 1, wherein in the supply step, the free dropping of the animal litter from above the storage space of the hopper is carried out at a center location in the lengthwise direction of the storage space.

3. The method of filling a container with animal litter according to claim 1, wherein the one or more first region delivery holes comprise a plurality of first region delivery holes at sections located in the first region and the one or more second region delivery holes comprise a plurality of second region delivery holes at sections located in the second region of the animal litter in the storage space, and in the filling step, the animal litter is delivered through the plurality of delivery holes from the first region and the second region into the containers, simultaneously and in equal amounts, simultaneously filling the animal litter into the containers.

4. The method of filling a container with animal litter according to claim 1, wherein the hopper has, with a dropping target location in the storage space of the animal litter during the supply step as a reference point, a first delivery hole group comprising a first group of the plurality of delivery holes disposed close to one end in the lengthwise direction of the storage space and a second delivery hole group comprising a second group of the plurality of delivery holes disposed close to the other end, the first delivery hole group and second delivery hole group each having n number of the delivery holes, wherein in the filling step, the animal litter is delivered from each of injection holes of the first delivery hole group, and filled into the containers disposed for each delivery hole, and then animal litter is delivered and filled from each injection hole located at an nth to a 1st position from a reference point of the second delivery hole group, into each container that has been filled with the animal litter from each injection hole located at a 1st to an nth position from a reference point of the first delivery hole group.

5. The method of filling a container with animal litter according to claim 1, wherein the hopper is provided with the plurality of delivery holes aligned at equal spacing and in a straight line along the lengthwise direction of the storage space.

6. The method of filling a container with animal litter according to claim 1, wherein the filling step fills the containers with the animal litter by simultaneously delivering the animal litter from two or more different delivery holes among the plurality of delivery holes into the container.

7. The method of filling a container with animal litter according to claim 1, wherein the measuring step measures the blending ratios of the large-sized granules and the small-sized granules per the unit amount of the animal litter by using a sieve to sift predetermined amounts of the animal litter delivered from the plurality of delivery holes that are to be measured, into the large-sized granules and the small-sized granules.

8. The method of filling a container with animal litter according to claim 2, wherein the one or more first region delivery holes comprise a plurality of first region delivery holes at sections located in the first region and the one or more second region delivery holes comprise a plurality of second region delivery holes at sections located in the second region of the animal litter in the storage space, and in the filling step, the animal litter is delivered through the plurality of delivery holes from the first region and the second region into the containers, simultaneously and in equal amounts, simultaneously filling the animal litter into the containers.

9. The method of filling a container with animal litter according to claim 2, wherein the hopper has, with a dropping target location in the storage space of the animal litter during the supply step as a reference point, a first delivery hole group comprising a first group of the plurality of delivery holes disposed close to one end in the lengthwise direction of the storage space and a second delivery hole group comprising a second group of the plurality of delivery holes disposed close to the other end, the first delivery hole group and second delivery hole group each having n number of the delivery holes, wherein in the filling step, the animal litter is delivered from each of injection holes of the first delivery hole group, and filled into the containers disposed for each delivery hole, and then animal litter is delivered and filled from each injection hole located at an nth to a 1st position from a reference point of the second delivery hole group, into each container that has been filled with the animal litter from each injection hole located at a 1st to an nth position from a reference point of the first delivery hole group.

10. The method of filling a container with animal litter according to claim 3, wherein the hopper has, with a dropping target location in the storage space of the animal litter during the supply step as a reference point, a first delivery hole group comprising a first group of the plurality of delivery holes disposed close to one end in the lengthwise direction of the storage space and a second delivery hole group comprising a second group of the plurality of delivery holes disposed close to the other end, the first delivery hole group and second delivery hole group each having n number of the delivery holes, wherein in the filling step, the animal litter is delivered from each of injection holes of the first delivery hole group, and filled into the containers disposed for each delivery hole, and then animal litter is delivered and filled from each injection hole located at an nth to a 1st position from a reference point of the second delivery hole group, into each container that has been filled with the animal litter from each injection hole located at a 1st to an nth position from a reference point of the first delivery hole group.

11. The method of filling a container with animal litter according to claim 8, wherein the hopper has, with a dropping target location in the storage space of the animal litter during the supply step as a reference point, a first delivery hole group comprising the plurality of delivery holes disposed close to one end in the lengthwise direction of the storage space and a second delivery hole group comprising the plurality of delivery holes disposed close to the other end, the first delivery hole group and second delivery hole group each having n number of the delivery holes, wherein in the filling step, the animal litter is delivered from each of injection holes of the first delivery hole group, and filled into the containers disposed for each delivery hole, and then animal litter is delivered and filled from each injection hole located at an nth to a 1st position from the reference point of the second delivery hole group, into each container that has been filled with the animal litter from each injection hole located at a 1st to an nth position from the reference point of the first delivery hole group.

12. The method of filling a container with animal litter according to claim 2, wherein the hopper is provided with the plurality of delivery holes aligned at equal spacing and in a straight line along the lengthwise direction of the storage space.

13. The method of filling a container with animal litter according to claim 3, wherein the hopper is provided with the plurality of delivery holes aligned at equal spacing and in a straight line along the lengthwise direction of the storage space.

14. The method of filling a container with animal litter according to claim 8, wherein the hopper is provided with the plurality of delivery holes aligned at equal spacing and in a straight line along the lengthwise direction of the storage space.

15. The method of filling a container with animal litter according to claim 4, wherein the hopper is provided with the plurality of delivery holes aligned at equal spacing and in a straight line along the lengthwise direction of the storage space.

16. The method of filling a container with animal litter according to claim 10 wherein the hopper is provided with the plurality of delivery holes aligned at equal spacing and in a straight line along the lengthwise direction of the storage space.

17. The method of filling a container with animal litter according to claim 11, wherein the hopper is provided with the plurality of delivery holes aligned at equal spacing and in a straight line along the lengthwise direction of the storage space.

18. The method of filling a container with animal litter according to claim 2, wherein the filling step fills the containers with the animal litter by simultaneously delivering the animal litter from two or more different delivery holes among the plurality of delivery holes into the container.

19. The method of filling a container with animal litter according to claim 3, wherein the filling step fills the containers with the animal litter by simultaneously delivering the animal litter from two or more different delivery holes among the plurality of delivery holes into the container.

20. The method of filling a container with animal litter according to claim 8, wherein the filling step fills the containers with the animal litter by simultaneously delivering the animal litter from two or more different delivery holes among the plurality of delivery holes into the container.

* * * * *